US009068377B2

(12) United States Patent
Lagos et al.

(10) Patent No.: US 9,068,377 B2
(45) Date of Patent: Jun. 30, 2015

(54) RIBBON SEALED LOCK ASSEMBLIES AND METHODS

(71) Applicant: Andersen Corporation, Bayport, MN (US)

(72) Inventors: Gerard Lagos, St. Paul, MN (US); Les Stener, Minneapolis, MN (US); Tim Kelley, Stillwater, MN (US); Bryan Kendall, River Falls, WI (US); Kurt Koenig, Stillwater, MN (US)

(73) Assignee: ANDERSON CORPORATION, Bayport, MN (US)

( * ) Notice: Subject to any disclaimer, the term of this patent is extended or adjusted under 35 U.S.C. 154(b) by 67 days.

(21) Appl. No.: 13/827,274

(22) Filed: Mar. 14, 2013

(65) Prior Publication Data

US 2014/0167426 A1 Jun. 19, 2014

Related U.S. Application Data

(60) Provisional application No. 61/739,642, filed on Dec. 19, 2012.

(51) Int. Cl.

| | |
|---|---|
| ***E05C 3/04*** | (2006.01) |
| ***E05B 63/00*** | (2006.01) |
| ***E05B 17/00*** | (2006.01) |
| *E05C 9/02* | (2006.01) |
| *E05C 9/18* | (2006.01) |

(52) U.S. Cl.

CPC ..... *E05B 63/0052* (2013.01); *E05C 9/021* (2013.01); *E05C 9/1875* (2013.01); *E05B 17/002* (2013.01)

(58) Field of Classification Search

CPC ... E05B 17/002; E05B 63/0052; E05B 41/00; E05C 9/021; E05C 9/1875

USPC ..... 292/202, 336.3, 1, 154, 211, DIG. 20, 292/DIG. 47, DIG. 70, DIG. 71; 49/394, 395

See application file for complete search history.

(56) References Cited

U.S. PATENT DOCUMENTS

| | | | | | |
|---|---|---|---|---|---|
| 109,374 | A | * | 11/1870 | Beardsley | 292/190 |
| 4,803,808 | A | * | 2/1989 | Greisner | 49/394 |
| 5,161,839 | A | * | 11/1992 | Piltingsrud et al. | 292/241 |
| 5,318,333 | A | * | 6/1994 | Dreifert | 292/336.3 |
| 5,778,602 | A | * | 7/1998 | Johnson et al. | 49/449 |
| 5,839,767 | A | * | 11/1998 | Piltingsrud | 292/336.3 |
| 5,927,767 | A | * | 7/1999 | Smith et al. | 292/158 |
| 5,927,771 | A | * | 7/1999 | Simon et al. | 292/241 |
| 6,135,511 | A | * | 10/2000 | Smith et al. | 292/156 |
| 6,161,881 | A | * | 12/2000 | Babka et al. | 292/26 |
| 6,354,639 | B1 | * | 3/2002 | Minter et al. | 292/142 |
| 6,367,853 | B1 | * | 4/2002 | Briggs | 292/336.3 |
| 6,425,611 | B1 | * | 7/2002 | Minter et al. | 292/336.3 |
| 6,450,554 | B1 | * | 9/2002 | Rotondi et al. | 292/158 |
| 6,546,671 | B2 | * | 4/2003 | Mitchell et al. | 49/185 |
| 7,004,515 | B2 | * | 2/2006 | Timothy | 292/137 |

(Continued)

*Primary Examiner* — Kristina Fulton
*Assistant Examiner* — Christine M Mills
(74) *Attorney, Agent, or Firm* — Mueting Raasch & Gebhardt, P.A.

(57) ABSTRACT

The lock assemblies as described herein engage with keepers on movable sashes and include features designed to provide additional sealing functions to the lock assembly by incorporating a ribbon seal within a catch housing of the lock assembly.

25 Claims, 7 Drawing Sheets

(56) References Cited

U.S. PATENT DOCUMENTS

| | | | | |
|---|---|---|---|---|
| 7,412,800 | B2 * | 8/2008 | Maier | 49/185 |
| 7,708,322 | B2 * | 5/2010 | Timothy et al. | 292/137 |
| 7,963,577 | B2 * | 6/2011 | Wolf | 292/241 |
| 8,269,627 | B2 | 9/2012 | Gore et al. | |
| 8,353,541 | B2 * | 1/2013 | Minter | 292/137 |
| 8,610,002 | B2 * | 12/2013 | Lohman | 174/368 |
| 8,844,985 | B2 * | 9/2014 | Liang et al. | 292/242 |
| 2014/0070547 | A1 * | 3/2014 | Minter et al. | 292/101 |

* cited by examiner

RIBBON SEALED LOCK ASSEMBLIES AND METHODS

RELATED APPLICATION

This application claims the benefit of U.S. Provisional Patent Application No. 61/739,642 titled RIBBON SEALED WINDOW LOCK COVER filed on Dec. 19, 2012, which is hereby incorporated by reference in its entirety.

Lock assemblies for locking and unlocking movable sashes that a sliding ribbon seal to obstruct openings in the lock assemblies and related methods are described herein.

BACKGROUND

Sash locks for casement and awning windows are well known. Casement and awning windows are typically defined as having one or more glass panels within a sash, with the sash movable within a frame. The sash is mounted in a window frame which is defined by a head jamb on the top, a sill on the bottom and two side jambs. Typically, the sash is secured to the frame via hinges and a window operator which moveably attaches the sash to the frame.

Locks are used to hold the sash closed and, in some embodiments, to assist with sealing the sash in the frame. In some instances, however, the sash lock can, itself, provide an opening through which air and/or light can pass through a window when closed.

SUMMARY

Sash lock assemblies including a ribbon seal located in a catch housing are described herein. The ribbon seal moves along a ribbon seal path to obstruct an opening through the catch housing while the catch is moved between its locked and unlocked positions.

The lock assemblies described herein include, in one or more embodiments, a ribbon seal that slides within a ribbon seal path that guides the ribbon seal through the catch housing to obstruct openings through the lock assembly. The obstruction provided by the ribbon seal may be sufficient to prevent or severely limit light from passing through the catch housing and may, in one or more embodiments, also prevent or limit the passage of air through the lock assembly.

In a first aspect, one or more embodiments of a lock assembly for releasably locking a sash component in a closed position with respect to a frame component as described herein may include: a keeper on the sash component; a catch housing attached to the frame component, wherein the catch housing defines a ribbon seal path through the catch housing; a catch located in the catch housing, the catch movable within the catch housing between locked and unlocked positions, the catch configured to engage the keeper when the catch is in the locked position and the sash component is in a closed position; and a ribbon seal located in the catch housing, wherein the ribbon seal is positioned in the ribbon seal path, and wherein the ribbon seal is operably connected to the catch, such that movement of the catch between the locked and unlocked positions moves ribbon seal through the ribbon seal path.

In one or more embodiments of the lock assemblies described herein, the ribbon seal slides along the ribbon seal path as the catch moves between the locked and unlocked positions.

In one or more embodiments of the lock assemblies described herein, the ribbon seal path comprises a serpentine curved path.

In one or more embodiments of the lock assemblies described herein, the ribbon seal path comprises a serpentine curved path comprising three curves.

In one or more embodiments of the lock assemblies described herein, at least a portion of the ribbon seal path is defined by one or more walls within the catch housing.

In one or more embodiments of the lock assemblies described herein, at least a portion of the ribbon seal path is defined by one or more posts within the catch housing.

In one or more embodiments of the lock assemblies described herein, the catch housing comprises a base and a cover, and wherein the ribbon seal path is defined in the base and/or the cover. In one or more embodiments at least a portion of the ribbon seal path comprises a slot formed between two opposing walls attached to the base.

In one or more embodiments of the lock assemblies described herein, the ribbon seal comprises an opening formed through the ribbon seal, and wherein the catch extends through the opening.

In one or more embodiments of the lock assemblies described herein, the catch rotates about a catch axis when the catch moves between the locked and unlocked positions, and wherein the catch comprises a catch lever comprising a free end located distal from the catch axis, and further wherein the ribbon seal is located between the free end of the catch lever and the catch axis.

In one or more embodiments of the lock assemblies described herein, the ribbon seal comprises visible indicia configured to indicate whether the catch is in the locked or unlocked position. In one or more embodiments, the visible indicia comprises two or more different colors on the ribbon seal. In one or more embodiments, the visible indicia comprises two or more areas of different reflectivity on the ribbon seal.

In one or more embodiments of the lock assemblies described herein, the assembly further include a switch configured to provide an indication that the catch is in the locked or unlocked position. In one or more embodiments, the switch comprises a sensor configured to detect the position of the ribbon seal in the ribbon seal path. In one or more embodiments, the switch comprises a light that is configured to emit light to indicate that the catch is in one of the locked and unlocked positions. In one or more embodiments, the switch is configured to provide a signal to an external control device, wherein the signal is indicative of whether the catch is in the locked or unlocked position.

In one or more embodiments, the lock assemblies may include a motor operably connected to the ribbon seal and configured to move the ribbon seal within the ribbon seal path, wherein the motor and the ribbon seal are configured to move the catch between the locked and unlocked positions.

In a second aspect, one or more embodiments of a lock assembly for releasably locking a sash component in a closed position with respect to a frame component as described herein may include: a keeper on the sash component; a catch housing attached to the frame component, wherein the catch housing defines a ribbon seal path through the catch housing, wherein the ribbon seal path comprises a serpentine curved path; a catch located in the catch housing, the catch movable within the catch housing between locked and unlocked positions, the catch configured to engage the keeper when the catch is in the locked position and the sash component is in a closed position, wherein the catch rotates about a catch axis when the catch moves between the locked and unlocked positions; and a ribbon seal located in the catch housing, wherein the ribbon seal is positioned in the ribbon seal path, and wherein the ribbon seal is operably connected to the catch, such that movement of the catch between the locked and unlocked positions slides the ribbon seal along the ribbon seal path; wherein the catch comprises a catch lever comprising a free end located distal from the catch axis, and further wherein the ribbon seal is located between the free end of the catch lever and the catch axis.

In one or more embodiments of the lock assemblies described herein, the ribbon seal comprises an opening formed through the ribbon seal, and wherein the catch extends through the opening.

In a third aspect, one or more embodiments of a method of closing an opening in a lock assembly for releasably locking a sash component may include: moving a catch within a catch housing between locked and unlocked positions, wherein the catch engages a keeper on a sash component when the catch is in the locked position and the sash component is in a closed position; and moving a ribbon seal through a ribbon seal path in the catch housing when moving the catch between the locked and unlocked positions, wherein the catch is operably engaged with the ribbon seal.

In one or more embodiments of the methods described herein, moving the ribbon seal comprises sliding the ribbon seal along the ribbon seal path.

In one or more embodiments of the methods described herein, moving the ribbon seal comprises sliding the ribbon seal along a serpentine curved ribbon seal path.

In one or more embodiments of the methods described herein, moving the catch between the locked and unlocked positions comprises rotating the catch about a catch axis, and wherein the catch comprises a catch lever comprising a free end located distal from the catch axis, and further wherein the ribbon seal is located between the free end of the catch lever and the catch axis. In one or more embodiments, a method as described herein may include providing a visual indication that the catch is in the locked or unlocked position by providing visible indicia on the ribbon seal.

In a fifth aspect, one or more embodiments of a lock assembly for releasably locking a sash component in a closed position with respect to a frame component as described herein may include: a catch housing that defines a ribbon seal path through the catch housing; a catch located in the catch housing, the catch movable within the catch housing between locked and unlocked positions, the catch configured to engage a keeper of a sash component when the catch is in the locked position and the sash component is in a closed position; and a ribbon seal located in the catch housing, wherein the ribbon seal is positioned in the ribbon seal path, and wherein the ribbon seal is operably connected to the catch, such that movement of the catch between the locked and unlocked positions moves ribbon seal through the ribbon seal path.

The above summary is not intended to describe each embodiment or every implementation of the lock assemblies and methods described herein. Rather, a more complete understanding of the invention will become apparent and appreciated by reference to the following Description of Illustrative Embodiments and claims in view of the accompanying figures of the drawing.

DESCRIPTION OF ILLUSTRATIVE EMBODIMENTS

Figure 1:
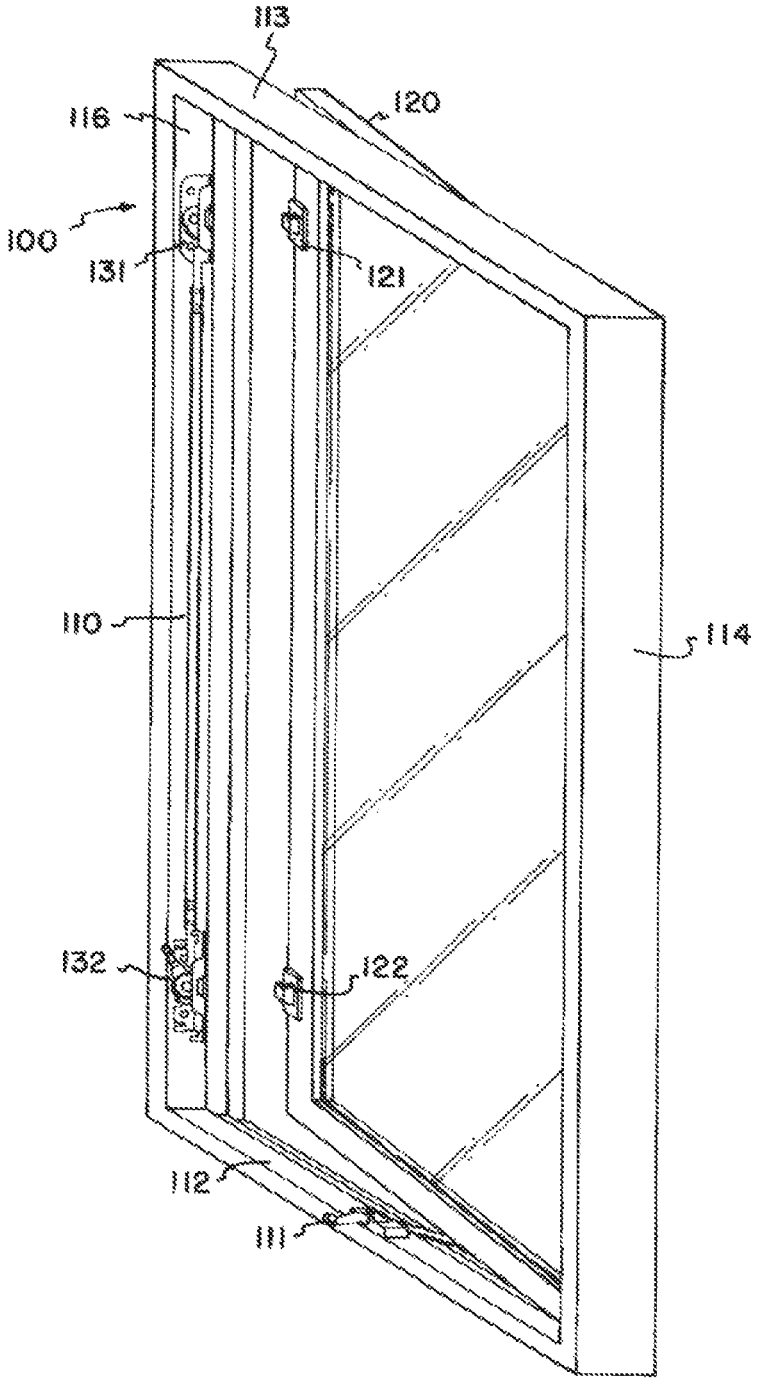
FIG. 1 is a perspective view of one illustrative embodiment of a window in which a lock assembly as described herein may be included.

In the following description of illustrative embodiments, reference is made to the accompanying figures of the drawing which form a part hereof, and in which are shown, by way of illustration, specific embodiments. It is to be understood that other embodiments may be utilized and structural changes may be made without departing from the scope of the present invention.

As described in U.S. Pat. No. 6,161,881 and depicted in FIG. 1, one illustrative embodiment of a casement window 100 including a sash 120 and a frame 110. The window frame 110 may include four components; namely, a top jamb 113, a sill 112, and left and right jambs 114 and 116, respectively. The sash 120 is pivotally attached to the left jamb 114 via one or more hinges (unseen). The sash 120 is further operatively connected to the frame 110 via window operator 111. Typically, window operator 111 will include a handle which can be used to open and close the window.

The right side of the sash 120 as depicted includes a top keeper 121 and a bottom keeper 122. While casement windows most commonly have two keepers, in one or more alternative embodiments, windows may be provided with as few as one keeper or three or more keepers. In the depicted embodiment, the top keeper releasably engages with the top lock assembly 131, while the bottom keeper 122 releasably engages with the bottom lock assembly 132.

The lock assemblies as described herein engage with keepers on the sashes of windows (or doors) as described herein by any suitable technique. The specific construction of the catch associated with a lock assembly and its associated keeper may vary in the lock assemblies as described herein. The lock assemblies as described herein do, however, include features designed to provide additional sealing functions to the lock assembly by incorporating a ribbon seal within a catch housing of the lock assembly, with the ribbon seal functioning to, in one or more embodiments, obstruct the passage of light and/or air through the catch housing. Although the lock assemblies are described herein primarily in connection with sash components in windows, the lock assemblies may also be used in moving sashes within other building components such as, e.g., doors, etc.

Figure 2:
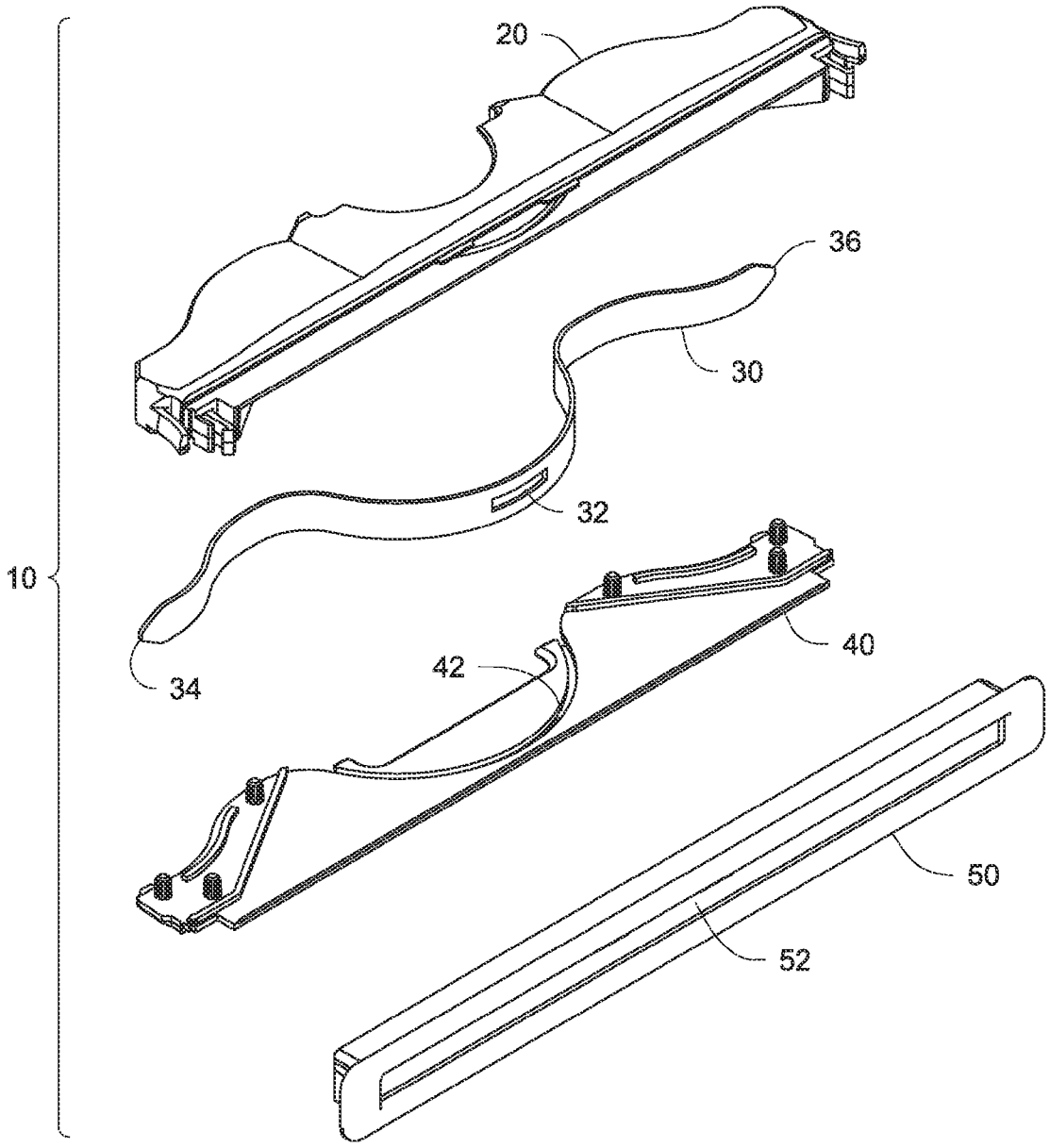
FIG. 2 is an exploded perspective view of one illustrative embodiment of a catch housing including a ribbon seal of a lock assembly as described herein.

One illustrative embodiment of a catch housing that may be included in a lock assembly as described herein is depicted in FIG. 2. The illustrative embodiment of a lock assembly 10 as seen in FIG. 2 includes a base 20, ribbon seal 30, cover 40, and faceplate 50. The faceplate 50 includes an opening 52 and the ribbon seal 30 obstructs the passage of light and/or air through the opening 52 in one or more embodiments of the catch housings as described herein. In one or more embodiments, the ribbon seal 30 may include an opening 32 through which a catch lever extends to operably connect the catch to the ribbon seal 30. The ribbon seal 30 includes a first end 34 and a second end 36. In one or more embodiments, the opening 32 in the ribbon seal 30 at which the catch lever operably connects to the ribbon seal 30 may be located proximate a midpoint of the ribbon seal between its first and 34 and its second end 36.

Although the opening 32 is depicted as being completely contained within the ribbon seal 30, in one or more alternative embodiments the ribbon seal opening 32 may be in the form of a slot or other structure that is capable of mechanically interlocking with the catch to move the ribbon seal 30 along the ribbon seal path as described herein.

The ribbon seal 30 may include a body that is made of a variety of different materials such as, e.g., polymers or other flexible materials that can move through the catch housing as described herein. In one or more embodiments the ribbon seal may include a coating or material that reduces frictional resistance to sliding of the ribbon seal. Furthermore, the ribbon seal 30 may preferably be made of materials that are impermeable to the passage of liquid and may also be opaque as well to block the passage of light therethrough.

Figure 3:
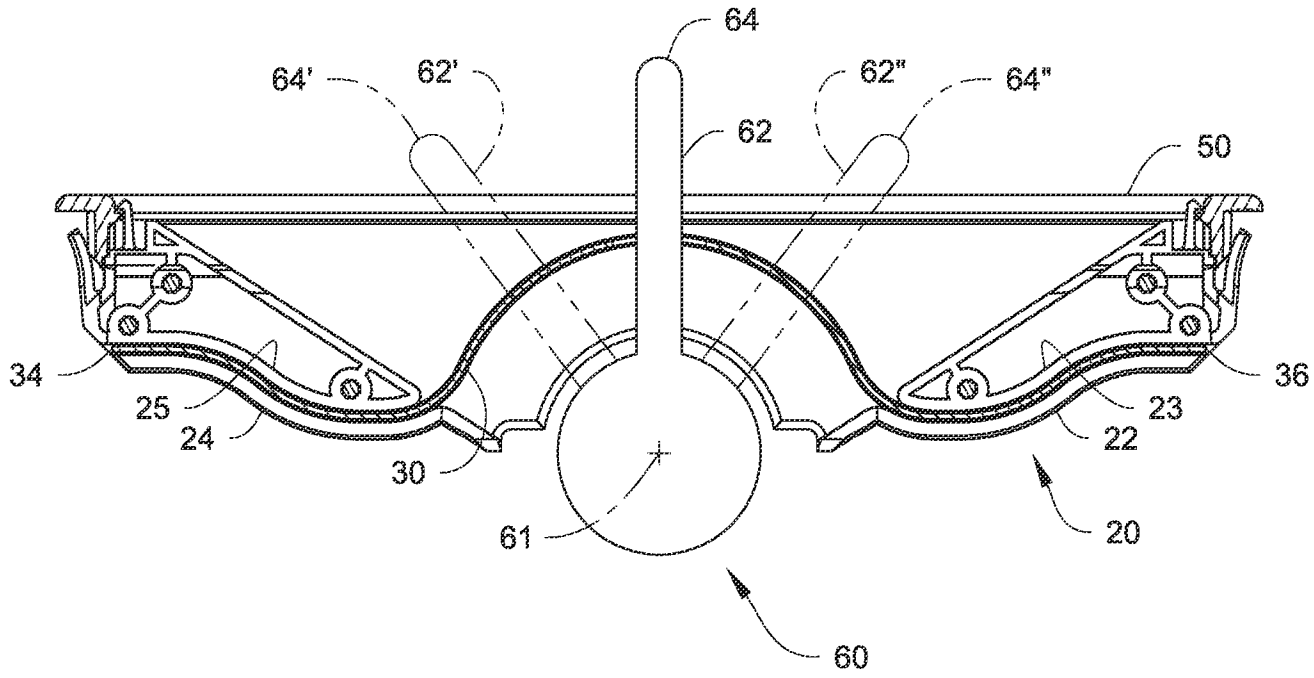
FIG. 3 depicts a base of the catch housing of FIG. 2 along with a catch and ribbon seal as described herein.

Referring to FIG. 3, one illustrative embodiment of the base 20 is depicted along with the faceplate 50 attached thereto. In particular, the underside of the base 20 (which is not seen in FIG. 2) is depicted in FIG. 3 along with a catch 60. The catch 60 includes a catch lever 62 having a distal end 64 located furthest from a catch axis 61 about which the catch 60 rotates when moving between a locked and unlocked position. As seen in FIG. 3, the catch 60 is in an intermediate position in which it is neither locked or unlocked. The catch 60 is depicted in the unlocked position in broken lines where the catch lever 62' is depicted as having been rotated to the left such that its distal end 64' is located to the left of the intermediate position depicted in solid lines. The catch 60 is also depicted in the locked position in broken lines where the catch lever 62" is depicted as having been rotated to the right such that its distal end 64" is located to the right of the intermediate position depicted in solid lines in FIG. 3.

Also seen in FIG. 3 is the ribbon seal 30. The catch lever 62 is depicted as having been inserted through an opening in the ribbon seal 30. In addition, ribbon seal 30 is shown as him located within a ribbon seal path that is defined within the catch housing 10. Movement of the catch 60 between its locked and unlocked positions moves the ribbon seal 30 through the ribbon seal path. In the illustrative embodiment depicted in FIGS. 2 and 3, the ribbon seal path is defined by one or more walls located within the catch housing 10. In particular, the illustrative embodiment depicted in FIG. 3 includes walls 22 and 23 which define a portion of the ribbon seal path on the right side of the catch 60 and walls 24 and 25 define a portion of the ribbon seal path on the left side of the catch 60.

In one or more embodiments, such as the illustrative embodiment depicted in FIGS. 2 and 3, the ribbon seal path may be a serpentine curved path that may, in one or more embodiments, include two or more curves. In the embodiment depicted in FIG. 3, the three curves of the ribbon seal path include a first curve defined between walls 22 and 23, a second curve defined between walls 24 and 25, and a third curve through which the catch lever 62 is threaded. In one or more embodiments, a serpentine curved ribbon seal path may include at least one curve that opens in a first direction and at least one curve that opens in the opposite direction. As described in connection with, e.g., FIG. 3, the third curve (through which catch lever 62 is threaded) opens toward the catch axis 61 and the first and third curves open in the opposite direction towards the free end 64 of the catch lever 62.

Although the depicted illustrative embodiments include a serpentine curved ribbon seal path, one or more alternative embodiments of lock assemblies including a ribbon seal may have a ribbon seal that moves within a ribbon seal path that is not a serpentine curved path, i.e., the ribbon seal path may be straight, may have a single curve, etc.

Because the catch 60 is in its neutral position in FIG. 3, the first end 34 and the second end 36 of the ribbon seal 30 are located within the slots formed by walls 22 and 23, as well as walls 24 and 25. Movement of catch 60 between its locked and unlocked positions, however, causes the ribbon seal 32 slide within the slots by walls 22 and 23 and walls 24 and 25.

Although in the depicted embodiment, the ribbon seal path is largely defined by the walls 22, 23, 24, and 25 that extend from the base 20, in one or more alternative embodiments, the ribbon seal path may be defined by structures attached to either or both of the base 20 and the cover 40. For example, cover 40 as depicted in FIG. 2, may include, in one or more embodiments, a channel 42 that may assist in defining the ribbon seal path as described herein.

Figure 4A:
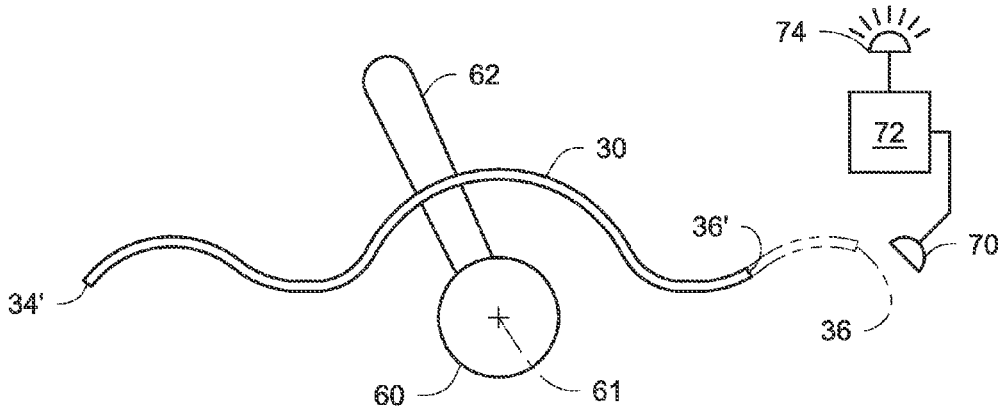
FIG. 4A depicts the catch and ribbon seal of FIG. 3 with the base of the catch housing removed for clarity and the catch in the unlocked position.
Figure 4B:
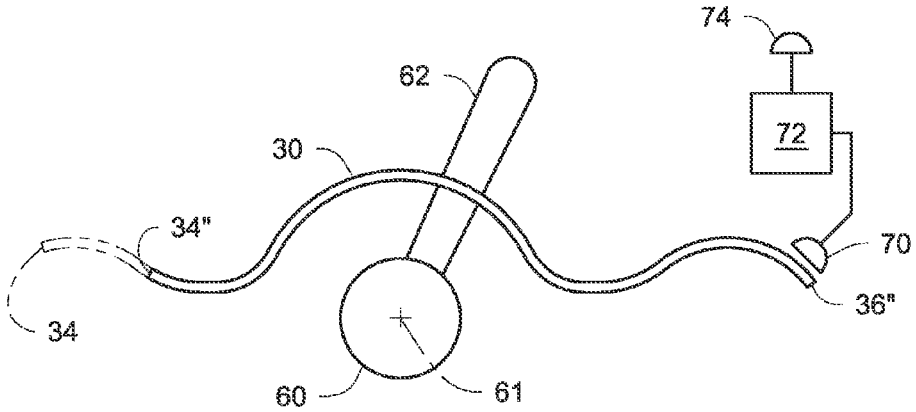
FIG. 4B depicts the catch and ribbon seal of FIG. 3 with the base of the catch housing removed for clarity and the catch in the locked position.

To better illustrate movement of the ribbon seal 30, reference can be made to FIGS. 4A and 4B. In particular, FIG. 4A depicts the catch lever 62 of the catch 60 in the unlocked position such that the ribbon seal 30 has been shifted to the left. As a result, the second end 36 of the ribbon seal 30 has been shifted to the left and is indicated as reference number 36' while the first end of the ribbon seal 30 is indicated by reference number 34'. The neutral position of the second end 36 of the ribbon seal 30 is depicted in broken lines in FIG. 4A.

The catch lever 62 of the catch 60 is in the locked position in FIG. 4B such that the ribbon seal 30 has been shifted to the right. As a result, the first end 34 of the ribbon seal 30 has been shifted to the right and is indicated by reference number 34" while the second end of the ribbon seal 30 is indicated by reference number 36". The neutral position of the first end 34 of the ribbon seal 30 is depicted in broken lines in FIG. 4B.

Another optional feature that may be included in one or more embodiments of the lock assemblies as described herein is also depicted in connection with FIGS. 4A and 4B. In particular, the lock assembly may include a switch that is configured to provide an indication that the catch is in the locked or unlocked position. In the depicted embodiment, the switch includes a sensor 70, and a control unit 72, and a light 74 (although all of these components may not be present in every switch used in connection with the lock assemblies described herein).

In operation, the sensor 70 is positioned such that it can detect the presence of the ribbon seal 30 only when the ribbon seal 30 is in a location within the ribbon seal path that corresponds to the catch 60 being in the unlocked position as depicted in FIG. 4B. When the sensor 70 of the switch detects the presence of the ribbon seal 30, the control unit 72 operates light 74 such that the light 74 emits light to provide an indication that the catch 60 is in the unlocked position. In one or more alternative embodiments, the opposite function could be provided, i.e., the light 74 could emit light only when the catch 60 is in the locked position. In still one or more other alternative embodiments, the light 74 could emit light under all conditions, with the light 74 being operated to provide an indication as to whether the catch is in the locked or unlocked positions based on, e.g., the color of the light emitted, whether the light emitted is of constant intensity or varying (e.g., blinking, etc.), etc.

In still other embodiments, the sensor 70 and control unit 72 may be configured to provide a signal to an external control device, wherein the signal is indicative of whether the catch is in the locked or unlocked position. One or more examples of potentially suitable external control devices with which the sensor 70 and control unit 72 may be used may be described in, e.g., U.S. Pat. No. 8,269,627 to Gore et al.

Figure 5:
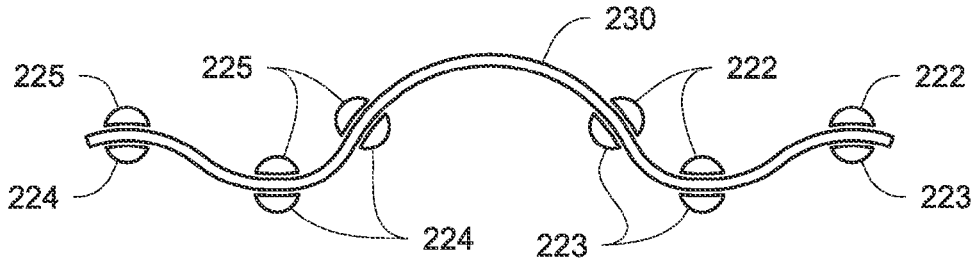
FIG. 5 depicts an alternative illustrative embodiment of structures for defining a ribbon seal path as described herein.

Furthermore, in one or more alternative embodiments, the ribbon seal path may be defined by posts or other structures that may not be considered to be walls as described herein. One illustrative embodiment of such an alternative is depicted in FIG. 5, where a ribbon seal 230 is depicted as passing between pairs of opposing posts. In this view, the ribbon seal 230 defines the ribbon seal path within a catch housing. In place of walls to define the ribbon seal path, pairs of opposing posts 222 and 223 are depicted along the right side of the ribbon seal 230, while pairs of opposing posts 224 and 225 are depicted along the left side of the ribbon seal 230. Many other different structures may, of course, be used in place of the walls or posts described herein to define the ribbon seal path within a catch housing.

In one or more embodiments, the ribbon seals used in lock assemblies as described herein may include some form of visible indicia configured to indicate whether the catch is in the locked or unlocked position. In one or more embodiments, the visible indicia may include two or more different colors on the ribbon seal, two or more areas of different reflectivity, etc. With respect to the illustrative embodiment depicted in FIGS. 2-3, the ribbon seal 30 may display a first visible indicia between the opening 32 in the ribbon seal 30 through which catch lever 62 extends and the first end 34 of the ribbon seal 30 and a second visible indicia between the opening 32 and the second end 36 of the ribbon seal 30. As a result, when the catch lever 62 is in the locked position one of the visible indicia on the ribbon seal 30 may be viewed through an opening in the faceplate 50 and when the catch lever 62 is in the unlocked position, the other visible indicia on the ribbon seal 30 may be viewed through the opening in the faceplate 50.

Figure 6:
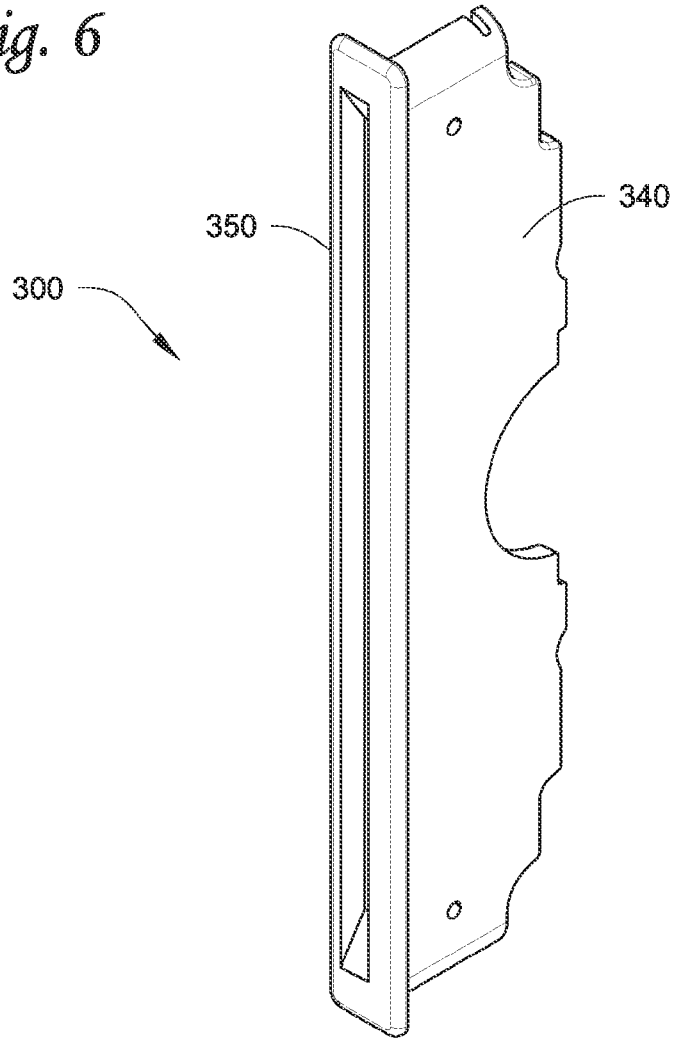
FIG. 6 is a perspective view of another illustrative embodiment of a catch housing of a lock assembly as described herein.
Figure 7:
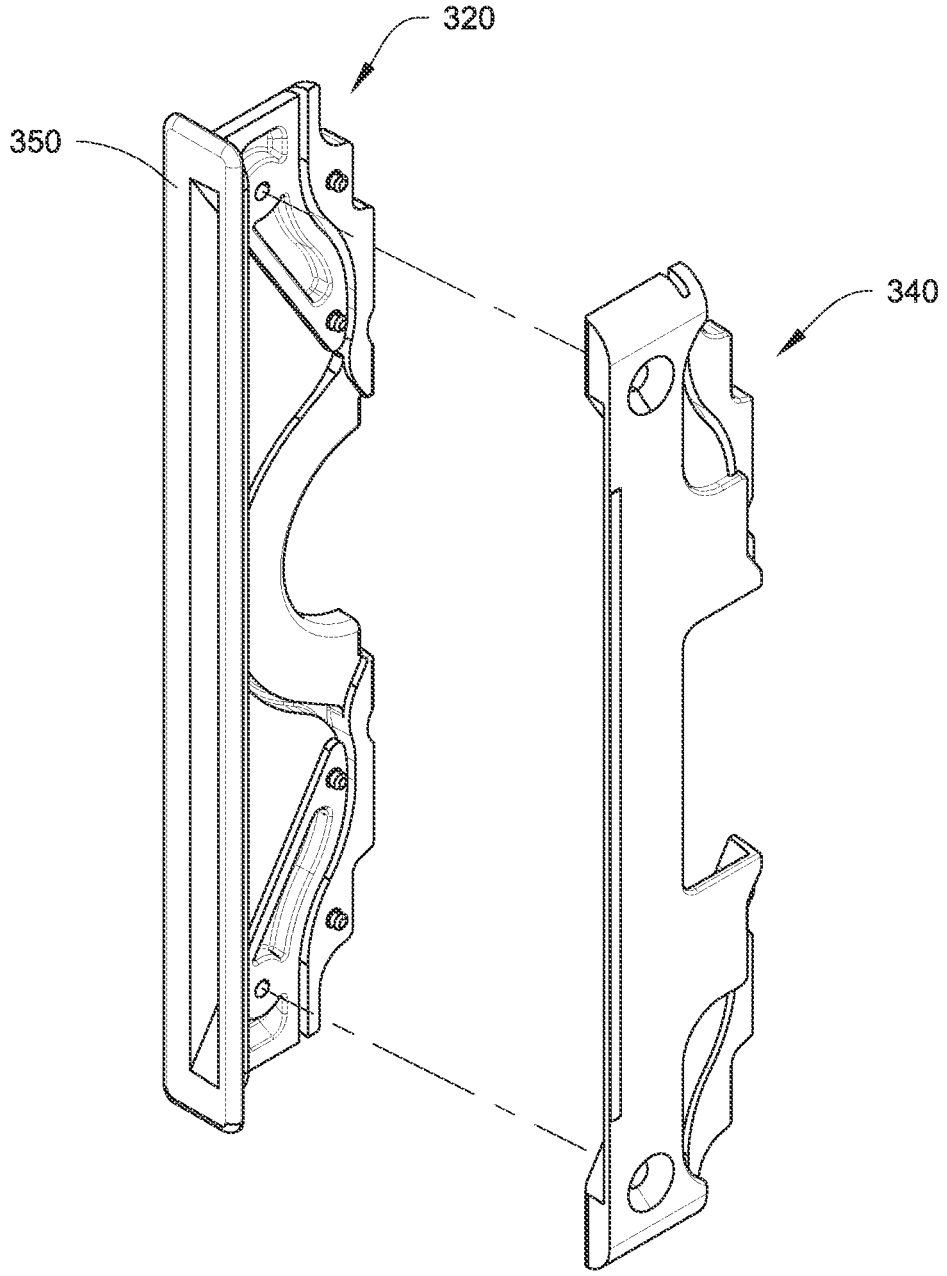
FIG. 7 is an exploded perspective view of the base and cover of the catch housing depicted in FIG. 6.

FIGS. 6-7 depict another alternative illustrative embodiment of a catch housing that may be used with a lock assembly as described herein. The illustrative embodiment of the catch housing 300 as seen in FIG. 6 includes a face plate 350 that is integrated with other components within the catch housing 300. In the illustrative embodiment of FIGS. 6-7, the faceplate 350 is integrated with the base 320 of the catch housing 300, and the cover 340 is attached to the base 322 formed the completed catch housing 300. The catch housing 300 further includes a ribbon seal path along which a ribbon seal moves during use of a lock assembly including the catch housing 300.

Figure 8:
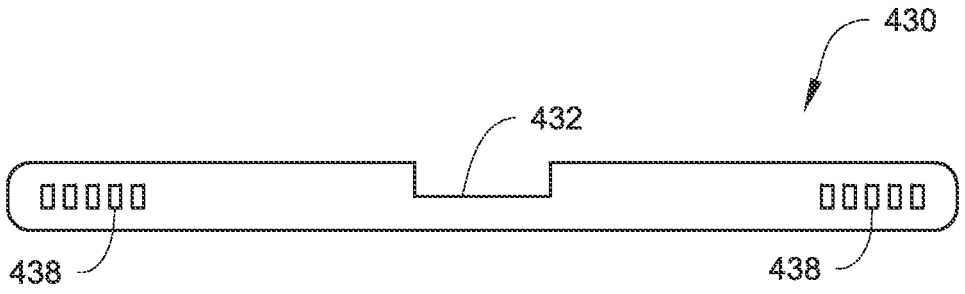
FIG. 8 is a plan view of another alternative embodiment of a ribbon seal that may be used in one or more embodiments of the lock assemblies described herein.

In one or more embodiments, the lock assemblies described herein may include a motor operably connected to the ribbon seal, with the motor being configured to move the ribbon seal within the ribbon seal path. Movement of the ribbon seal within the ribbon seal path by the motor can, in one or more embodiments, move the catch between the locked and unlocked positions. Referring to FIG. 8, one illustrative embodiment of a ribbon seal 430 that is configured for being operably connected to a motor may include features 438 in the form of, e.g., one or more apertures, slots, channels, posts, etc. that are configured to engage with a driven component such as, e.g., a gear, toothed wheel, pawl, etc. By engaging the features 438 of the ribbon seal 430 with a driven component, the ribbon seal 430 may be moved within a ribbon seal path as described herein. Such movement of the ribbon seal 430 within a ribbon seal path may cause a catch to move between a locked and unlocked position as described herein.

Another alternative feature depicted in connection with the ribbon seal 430 is a ribbon seal slot 432 in place of, e.g., the opening 32 depicted in connection with ribbon seal 30 as seen in FIG. 2. The ribbon seal slot 432 can be used, in one or more embodiment, to operably connect the ribbon seal 430 with a catch lever as described with the lock assemblies described herein.

Figure 9:
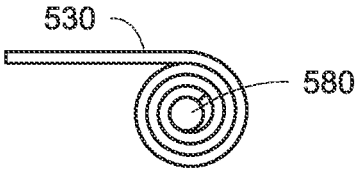
FIG. 9 is a side view of another alternative embodiment of a ribbon seal that may be used in one or more embodiments of the lock assemblies described herein.

Referring to FIG. 9, another illustrative embodiment of a ribbon seal 530 that may be used in connection with the lock assemblies described herein may be in the form of a coil that is operably connected to a post 580. Rotation of the post 580 can cause the ribbon seal 530 to uncoil or recoil (e.g., extend or retract, etc.), thereby causing the ribbon seal 530 to move within a ribbon seal path as described in connection with the lock assemblies described herein. Such movement of the ribbon seal 530 may be used to move a catch between a locked and unlocked position in one or more embodiments of the lock assemblies as described herein The complete disclosure of any patents, patent documents, and publications identified herein are incorporated by reference in their entirety as if each were individually incorporated. To the extent there is a conflict or discrepancy between this document and the disclosure in any such incorporated document, this document will control.

Illustrative embodiments of the lock assemblies and related methods are discussed and reference has been made to possible variations. These and other variations and modifications in the invention will be apparent to those skilled in the art without departing from the scope of the invention, and it should be understood that this invention is not limited to the illustrative embodiments set forth herein. Accordingly, the invention is to be limited only by the claims provided below and equivalents thereof. It should also be understood that this invention also may be suitably practiced in the absence of any element not specifically disclosed as necessary herein.

The invention claimed is:

1. A lock assembly for releasably locking a sash component in a closed position with respect to a frame component, the assembly comprising:

a keeper on the sash component;

a catch housing attached to the frame component, wherein the catch housing defines a ribbon seal path through the catch housing;

a catch located in the catch housing, the catch movable within the catch housing between locked and unlocked positions, the catch configured to engage the keeper when the catch is in the locked position and the sash component is in a closed position; and a ribbon seal located in the catch housing, wherein the ribbon seal is positioned in the ribbon seal path, and wherein the ribbon seal is operably connected to the catch, such that movement of the catch between the locked and unlocked positions moves ribbon seal through the ribbon seal path.

2. An assembly according to claim 1, wherein the ribbon seal slides along the ribbon seal path as the catch moves between the locked and unlocked positions.

3. An assembly according to claim 1, wherein the ribbon seal path comprises a serpentine curved path.

4. An assembly according to claim 1, wherein the ribbon seal path comprises a serpentine curved path comprising three curves.

5. An assembly according to claim 1, wherein at least a portion of the ribbon seal path is defined by one or more walls within the catch housing.

6. An assembly according to claim 1, wherein at least a portion of the ribbon seal path is defined by one or more posts within the catch housing.

7. An assembly according to claim 1, wherein the catch housing comprises a base and a cover, and wherein the ribbon seal path is defined in the base and/or the cover.

8. An assembly according to claim 7, wherein at least a portion of the ribbon seal path comprises a slot formed between two opposing walls attached to the base.

9. An assembly according to claim 1, wherein the ribbon seal comprises an opening formed through the ribbon seal, and wherein the catch extends through the opening.

10. An assembly according to claim 1, wherein the catch rotates about a catch axis when the catch moves between the locked and unlocked positions, and wherein the catch comprises a catch lever comprising a free end located distal from the catch axis, and further wherein the ribbon seal is located between the free end of the catch lever and the catch axis.

11. An assembly according to claim 1, wherein the ribbon seal comprises visible indicia configured to indicate whether the catch is in the locked or unlocked position.

12. An assembly according to claim 11, wherein the visible indicia comprises two or more different colors on the ribbon seal.

13. An assembly according to claim 11, wherein the visible indicia comprises two or more areas of different reflectivity on the ribbon seal.

14. An assembly according to claim 1, the assembly further comprising a switch configured to provide an indication that the catch is in the locked or unlocked position.

15. An assembly according to claim 14, wherein the switch comprises a sensor configured to detect the position of the ribbon seal in the ribbon seal path.

16. An assembly according to claim 14, wherein the switch comprises a light that is configured to emit light to indicate that the catch is in one of the locked and unlocked positions.

17. An assembly according to claim 14, wherein the switch is configured to provide a signal to an external control device, wherein the signal is indicative of whether the catch is in the locked or unlocked position.

18. An assembly according to claim 1, wherein the assembly further comprises a motor operably connected to the ribbon seal and configured to move the ribbon seal within the ribbon seal path, wherein the motor and the ribbon seal are configured to move the catch between the locked and unlocked positions.

19. A lock assembly for releasably locking a sash component in a closed position with respect to a frame component, the assembly comprising:

a keeper on the sash component;

a catch housing attached to the frame component, wherein the catch housing defines a ribbon seal path through the catch housing, wherein the ribbon seal path comprises a serpentine curved path;

a catch located in the catch housing, the catch movable within the catch housing between locked and unlocked positions, the catch configured to engage the keeper when the catch is in the locked position and the sash component is in a closed position, wherein the catch rotates about a catch axis when the catch moves between the locked and unlocked positions; and a ribbon seal located in the catch housing, wherein the ribbon seal is positioned in the ribbon seal path, and wherein the ribbon seal is operably connected to the catch, such that movement of the catch between the locked and unlocked positions slides the ribbon seal along the ribbon seal path;

wherein the catch comprises a catch lever comprising a free end located distal from the catch axis, and further wherein the ribbon seal is located between the free end of the catch lever and the catch axis.

20. An assembly according to claim 19, wherein the ribbon seal comprises an opening formed through the ribbon seal, and wherein the catch extends through the opening.

21. A method of closing an opening in a lock assembly for releasably locking a sash component, the method comprising:

moving a catch within a catch housing between locked and unlocked positions, wherein the catch engages a keeper on a sash component when the catch is in the locked position and the sash component is in a closed position; and moving a ribbon seal through a ribbon seal path in the catch housing when moving the catch between the locked and unlocked positions, wherein the catch is operably engaged with the ribbon seal.

22. A method according to claim 21, wherein moving the ribbon seal comprises sliding the ribbon seal along the ribbon seal path.

23. A method according to claim 21, wherein moving the ribbon seal comprises sliding the ribbon seal along a serpentine curved ribbon seal path.

24. A method according to claim 21, wherein moving the catch between the locked and unlocked positions comprises rotating the catch about a catch axis, and wherein the catch comprises a catch lever comprising a free end located distal from the catch axis, and further wherein the ribbon seal is located between the free end of the catch lever and the catch axis.

25. A method according to claim 24, the method further comprising providing a visual indication that the catch is in the locked or unlocked position by providing visible indicia on the ribbon seal.

* * * * *